US005113950A

United States Patent [19]

Krasnoff

[11] Patent Number: 5,113,950

[45] Date of Patent: May 19, 1992

[54] FOR PERCUSSIVE TOOLS, A HOUSING, A PNEUMATIC DISTRIBUTOR, AND A HAMMER PISTON MEANS THEREFOR

[76] Inventor: Eugene L. Krasnoff, 107 Kingsway Commons, Princeton, N.J. 08540

[21] Appl. No.: 670,879

[22] Filed: Mar. 18, 1991

[51] Int. Cl.[5] ..... E21B 1/00

[52] U.S. Cl. ..... 173/13; 173/17; 173/135

[58] Field of Search ..... 173/14, 15, 16, 17, 173/136, 135, 80, 91, 92; 91/234, 325; 137/516.15, 860

[56] References Cited

U.S. PATENT DOCUMENTS

| | | | |
|---|---|---|---|
| 3,193,024 | 7/1965 | Cleary | 173/135 |
| 3,651,874 | 3/1972 | Sudnishnikov et al. | 173/135 |
| 3,896,886 | 7/1975 | Roscoe, Jr. | 173/17 |
| 3,944,003 | 3/1976 | Curington | 173/17 |
| 3,970,153 | 7/1976 | Glen et al. | 173/17 |
| 4,194,435 | 3/1980 | Gaun et al. . | |
| 4,383,581 | 5/1983 | Shalashov . | |
| 4,446,929 | 5/1984 | Pillow | 173/17 |

FOREIGN PATENT DOCUMENTS

| | | | |
|---|---|---|---|
| 1218095 | 8/1984 | U.S.S.R. | 173/136 |

OTHER PUBLICATIONS

Halco DTH Hammers; Halifax Tool Co., Ltd.; illustrated flier, with technical specifications (one sheet, two sides) copy attached.

*Primary Examiner*—Mark Rosenbaum
*Assistant Examiner*—Allan M. Schrock
*Attorney, Agent, or Firm*—Bernard J. Murphy

[57] ABSTRACT

Replacing valves in prior percussive devices, the distributor is a simple tube, which can be of plastic construction, for admitting operative compressed air to drive and return chambers at opposite ends of the centrally-bored hammer piston. The tube-distributor effects a fine, substantially sealing, relatively slidable clearance with the hammer piston bore. The housing is a simple, uniform bore diameter cylinder in which the hammer piston reciprocates; tight-concentricity tolerance machining of the confronting inside and outside diameters of the cylindrical housing, distributor and hammer piston, respectively, is unnecesssary.

8 Claims, 6 Drawing Sheets

FIG. 2A
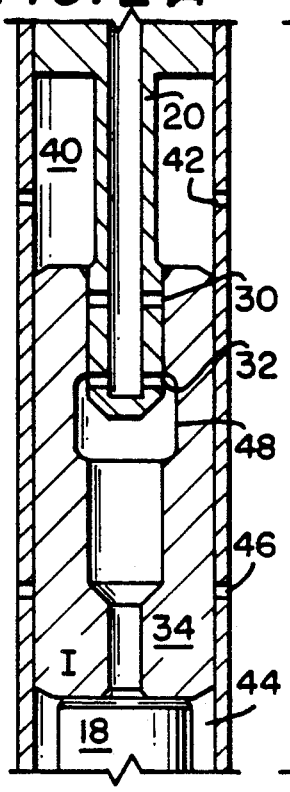
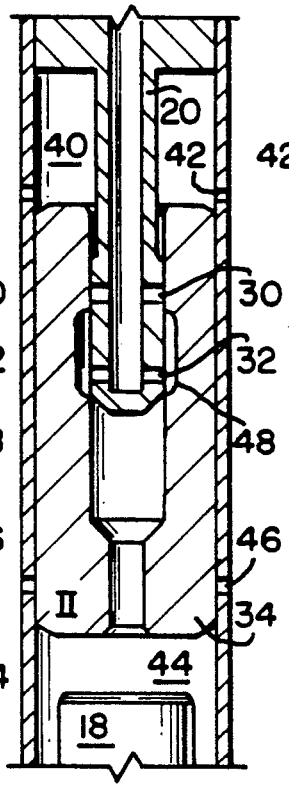
FIG. 2B
FIG. 2C
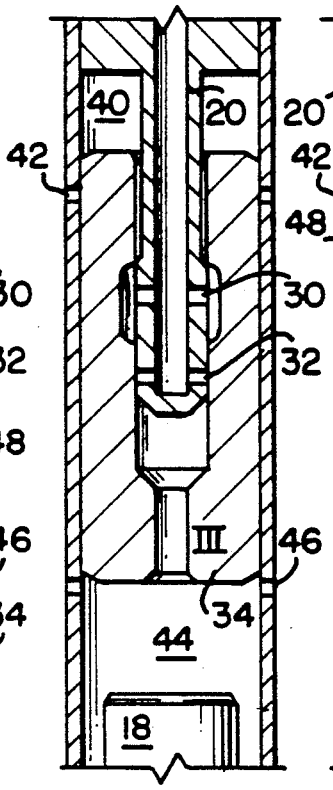
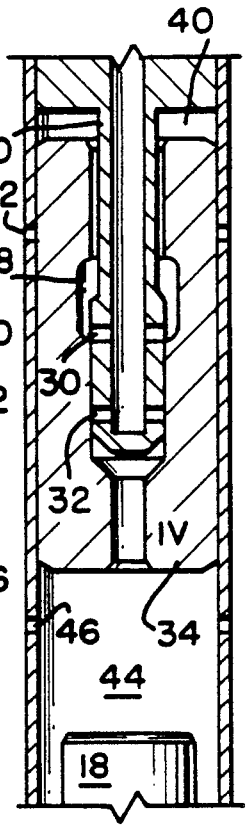
FIG. 2D
FIG. 3A
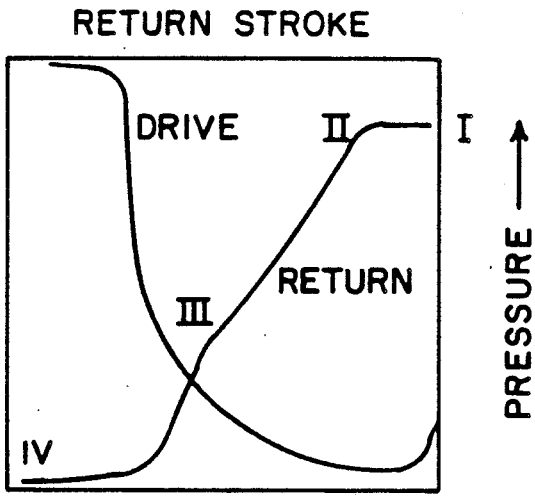
FIG. 3B
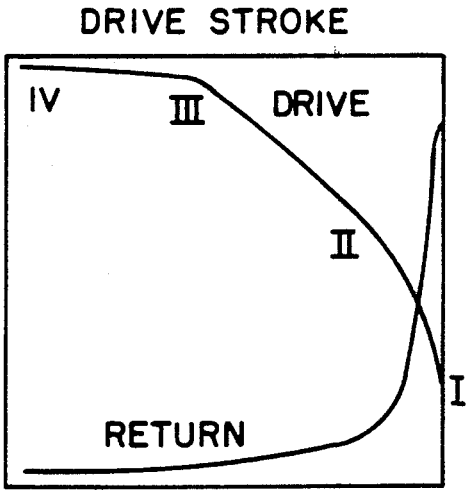
PRESSURE
DISPLACEMENT FIG. 4
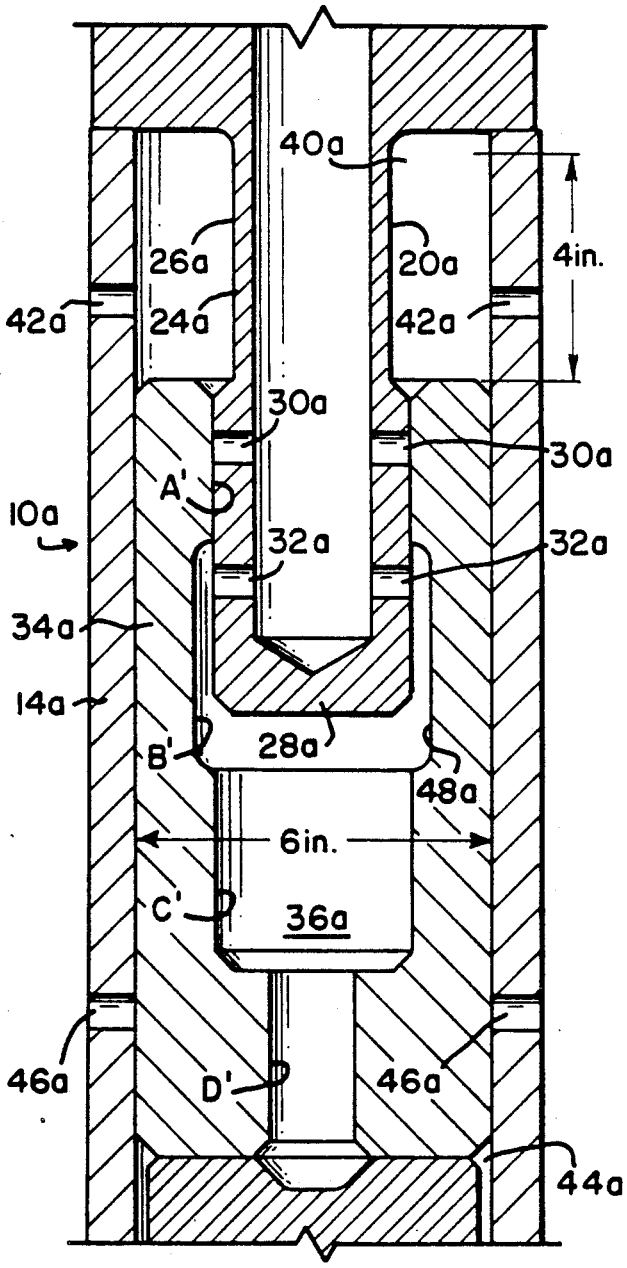
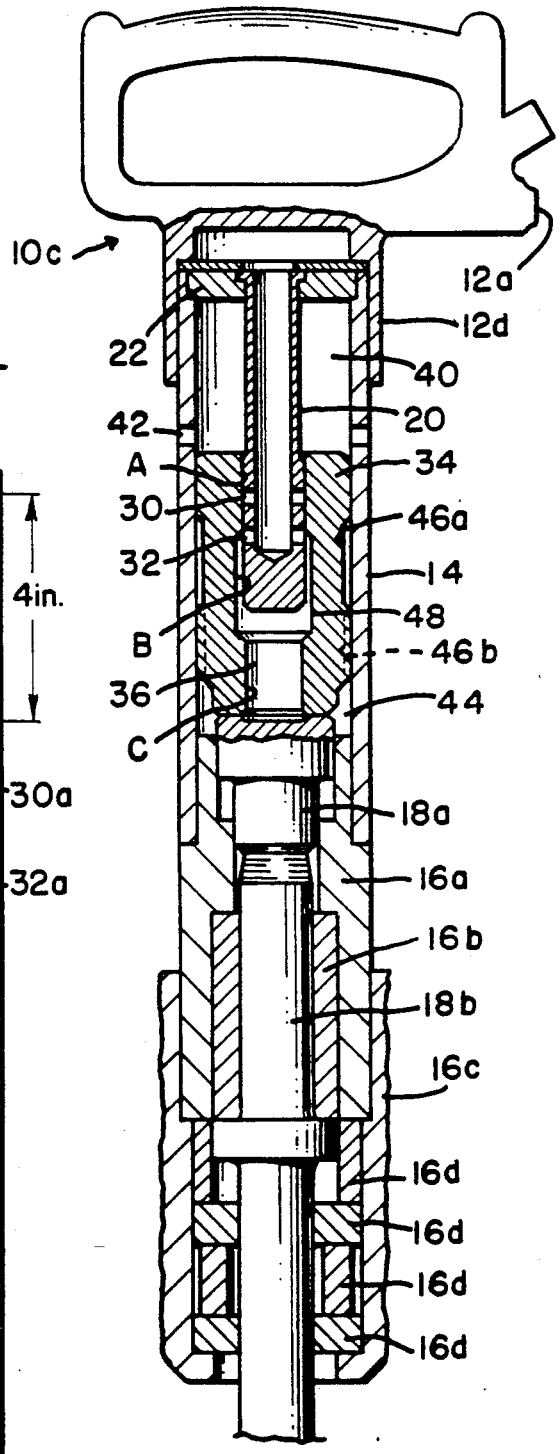
FIG. 6

FOR PERCUSSIVE TOOLS, A HOUSING, A PNEUMATIC DISTRIBUTOR, AND A HAMMER PISTON MEANS THEREFOR

This invention pertains, generally, to impact devices, namely: percussive tools operated by compressed air, and in particular to a housing, a pneumatic distributor, and a hammer piston means therefor.

Compressed air is the most widespread motive power for a variety of percussive tools used in construction, mining, ground engineering and many manufacturing operations. Large, high power examples include rock drills, mounted paving breakers and pile drivers. Hand-held paving breakers, chipping hammers, riveters, scalers, tampers and small hole, hand-held rock drills are typical low power applications of compressed air-powered percussive tools.

Since the applications are varied and numerous, many different cycles for air hammer pistons are used in the present state of the art. For the same reason, many design compromises are represented in currently used machines. Thus, for example, hand-held tools must have a short overall length and this usually dictates the use of one of the many valved air cycles. On the other hand, the use of a valve has disadvantages with respect to cost of manufacturing the valve and operational problems related to stuck or worn valve elements. In addition, the valve designs invariably lead to excess weight and a high cost of manufacturing the housing or barrel of the percussive tool.

A high-powered down hold rock drill (DHD) is an example of a percussive tool in which overall length and weight are not important design considerations. For the DHD the design must produce an efficient conversion of air power input to percussive power output. Similarly, to produce high, rock drilling penetration rates, the bore of the drill must be as large as possible while the outer diameter of the drill is limited by the hole size. Both of these considerations usually dictate the use of a valveless cycle for a DHD. However, the cost of manufacturing such DHD's is high because it involves a good deal of precision machining of the piston and the inside diameter of the elongated housing or wear sleeve of the machine. This is required to produce the porting galleries required for the functioning of the hammer piston cycle. Similarly, porting the high pressure supply air from the center of the drill pipe to these outer galleries leads to a number of machining operations which add significantly to cost.

It is an object of this invention to set forth, for a percussive tool which has (a) a housing, (b) a tool-holder chuck, and (c) a housing-confined, reciprocable, hammer piston with a longitudinal bore of diverse, inside diameters, a pneumatic distributor comprising an elongate tube, for conducting compressed air therethrough; said tube having (a) a mounting end for attachment thereof to an end of said housing of said device, and (b) a projecting portion for penetration of said bore of said hammer piston; wherein said projecting portion of said tube has (a) a terminal end, with a given, outside diameter, and a plurality of exhaust ports formed therein, and axially spaced apart along said portion, and (b) an extended shank with an outside diameter smaller than said given, outside diameter of said terminal end; and said terminal end of said tube defines a fine, substantially sealing, relatively slidable clearance with one of said inside diameters of said bore, in that said one inside diameter of said bore and said given outside diameter of said terminal end are nearly identical.

It is another object of this invention to disclose, for a percussive tool which has (a) a housing: and (b) a tool-holder chuck, a pneumatic distributor and hammer piston means, comprising an elongate tube, for conducting compressed air therethrough; said tube having (a) a mounting end for attachment thereof to an end of said housing of said device, and (b) a projecting portion; wherein said projecting portion of said tube has (a) a terminal end, with a given outside diameter and a plurality of exhaust ports formed therein, and axially spaced apart along said portion, and (b) an extended shank with an outside diameter smaller than said given, outside diameter of said terminal end; and a longitudinally-bored, hammer piston for slidable engagement of the bore thereof with said projecting portion of said tube; wherein said piston bore has a first inside diameter, of a given length, at one end thereof, and a second inside diameter intermediate the extent of said bore; and said given, outside diameter of said terminal end, of said projecting portion of said tube, has a length which is greater than said given length of said first inside diameter of said piston bore.

It is yet another object of this invention to set forth, for a percussive tool which has (a) a housing, (b) a tool-holder chuck, and means for admitting and discharging operative, compressed air thereinto and therefrom, hammer piston means for confinement and reciprocation within the housing, comprising a longitudinally-bored hammer piston; wherein said piston bore has a first inside diameter, of a given length, at one end thereof, a second inside diameter intermediate the extend of said bore, and a third inside diameter, remote from said first inside diameter which is contiguous with said second inside diameter and identical to said first inside diameter.

Further objects of this invention, as well as the novel features thereof, will become more apparent by reference to the following description taken in conjunction with the accompanying figures, in which:

FIGS. 2A through 2D are depictions of the hammer piston dispostions, within the cylindrical housing, during the cycling thereof;

FIGS. 3A and 3B represent plottings of the pneumatic pressures and hammer piston displacements during the cyclings thereof;

FIG. 4 is a cross-sectional view, like that of FIG. 1, showing the invention incorporated in that which can be a high-energy pile driver, or a mounted paving breaker, or the like;

FIGS. 6 and 7 illustrate complete assemblies of a small demolition tool and a lightweight riveter, respectively, which have the invention therewithin;

Figure 1:
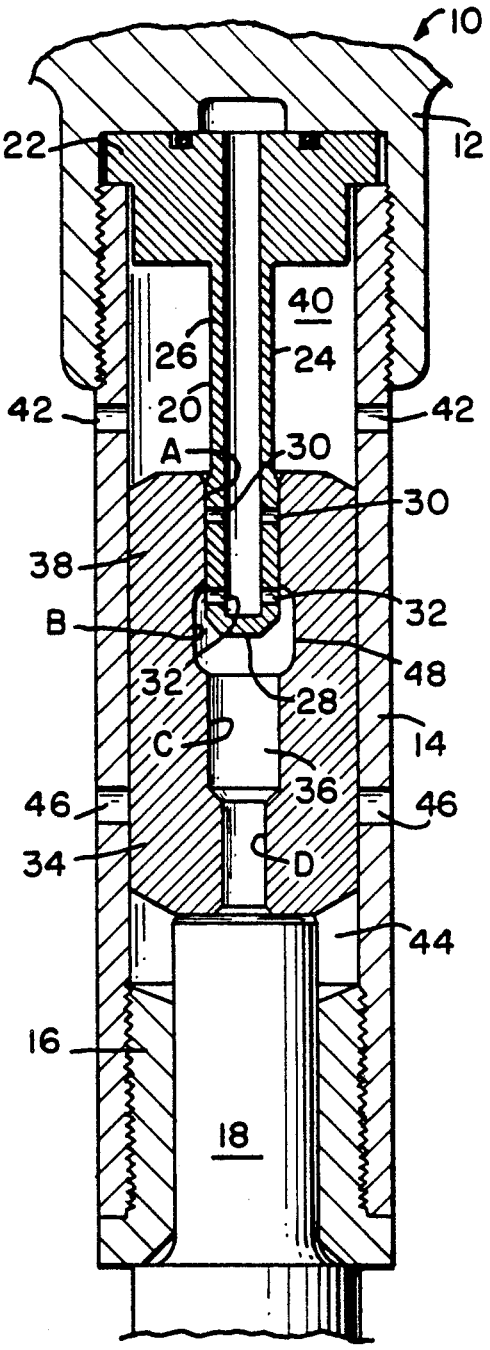
FIG. 1 is a cross-sectional view, taken along the axial centerline of a percussive tool showing an embodiment of the invention incorporated therein.

As shown in FIG. 1, a percussive tool or device 10 has a header 12 which (a) conducts operative compressed air thereinto, and (b) threadedly receives a simple, straight-cylindrical housing 14 having a constant inside diameter throughout its full length. The upper end of the housing 14 is externally threaded, for coupling thereof to the header 12. The opposite end of the housing 14 receives a conventional chuck 16, and the latter receives a similarly conventional tool or anvil 18. The novel pneumatic distributor 20 has a mounting end 22 which is captive between the header 12 and the upper end of the housing 14. Too, it has a projecting portion 24 comprising a shank 26 and a terminal end 28. The distributor 20, the same being an air-conducting tube, conveys the admitted compressed air from the header 12 to the terminal end 28 whereat a plurality of ports 30 and 32 are formed. The novel hammer piston 34 is an elongate, centrally-bored annulus having a straight, uniform constant-diameter and uninterrupted outside surface. It is slidably received onto the projecting portion of 24 of the distributor 20, via the central bore 36 therein. The annular wall 38 of the hammer piston 34, in this embodiment thereof, is uninterrupted. The bore 36 has a first inside diameter "A" of a given length, at the uppermost end thereof, a second inside diameter "B" thereadjacent or contiguous thereto, and intermediate the extent of the bore 36, a third inside diameter "C", contiguous with diameter "B", and remote from diameter "A", and a final inside diameter "D", contiguous with diameter "C" and at the lowermost end of the bore 36. Diameters "A" and "C" are identical, whereas diameter "B" and diameter "D" are larger and smaller, respectively.

The terminal end 28 of the distributor 20 has an outside diameter which is nearly identical to diameters "A" and "C" and, as a consequence thereof, the terminal end 28 defines a fine, substantially sealing, relatively slidable clearance with diameters "A" and "C".

The chamber 40 of the device 10 comprises a drive chamber volume, and the ports 42 formed in the housing 14 are the drive chamber exhaust ports. Chamber 44 of the device 10 comprises a return chamber volume, and ports 46 in the housing 14 are the return chamber exhaust ports.

The section of the bore 36 defined by diameter "B" comprises a porting gallery 48. Whereas diameter "A" and "C" occlude the ports 30 and 32, the gallery 48 opens the ports. The mounting end 22 of the distributor 20 is shown with an exaggerated radial clearance in the header 12 and the housing 14, to point out that it may be produced without any need for a fine, concentric tolerance. So also for the hammer piston 34; the same has only to have an outside diameter which is closely matched to the inside diameter of the housing, to minimize air leakage. It is required, only, for the outside diameter of the terminal end 28 of the distributor 20 be closely toleranced with respect to the inside diameters "A" and "C" of the hammer piston 34.

The functioning of the air cycle is depicted in the displacement and pressure sequences of FIGS. 2A-3B. The first hammer piston position "I" is at the normal impact point; here it is seen that the high pressure supply air communicates through the air distributor 20 and the porting gallery 48 in the piston 34 to the front or return chamber 44. In this first position the drive chamber exhaust ports 42 are open and it is clear that the drive chamber pressure is near ambient. Thus, the pressure force unbalance accelerates the piston 34 on its return or upward stroke. From position "I" to position "II" the pressures are nearly constant as shown in the return stroke pressure - displacement diagram 3A, and the piston velocity increases.

At position "II" the drive chamber exhaust ports 42 are about to close as is the return chamber supply ports 30. Then, between positions "II" and "III" both working chambers 40 and 44 are closed off. Thus, the high pressure return chamber air expands and continues to add momentum and energy to the piston return stroke. During this same time the drive chamber air is compressed by the upward displacement of the piston 34 as shown in the pressure - displacement diagram. At position "III" the return chamber exhaust ports 46 have just opened and the high pressure supply air is ready to communicate to the drive chamber 40. Beyond this point the supply air communicates with the drive chamber 40 through the distributor 20 and the porting gallery 48 while the return chamber 44 dumps through the exhaust ports 46.

At position "IV" the piston 34 has been decelerated to a top dead center state of no velocity. That is, between "III" and "IV" the reverse pressure force on the piston 34 decreases the piston energy and momentum to zero and the return stroke is completed.

Referring to the diagram of position "IV" (FIG. 2D) it is seen that further upward motion will close off the porting gallery 48 to the high pressure supply. Thus, the drive chamber 40 will be completely sealed and will form an air cushion to prevent backhead impact under unusual operating conditions. Such cushions are usually built into conventional valveless air hammers, but they require appropriate additional machining of the piston and drive chamber housing to form the cushion zone.

From the top dead center position "IV" the drive stroke proceeds through the previous positions, and the pressure - displacement diagram shown in FIG. 3B is the result. It is seen that piston acceleration continues until just before the impact position "I" is reached. The result is a high energy blow on the tool 18, at which time the return stroke sequence is repeated in a cyclic manner.

When the tool 18 is not in place the piston 34 will move forward of position "I" and it is seen that the supply air holes 32 in the distributor 20 will be cut off from the porting gallery 48. Thus, the return chamber 44 becomes a front cushion which prevents piston - front end impact when necessary. Similarly, at start-up with the tool 18 in a lowermost position, the return chamber 44 is not supplied with supply air while the latter short circuits from the distributor 20 through the drive chamber 40 and out the drive chamber exhaust ports 42. This keeps the piston 34 in its low position and the device 10 will not cycle. To start the device cycling it is only necessary to apply to normal feed force; this moves the tool 18 into position and automatically starts the cycle as the position shown at "I" is approached.

The inventive concept permits performance gains to be realized over conventional valveless and valve-cycle percussive devices or tools. Relative to the former, supply air leakage in the clearance between the piston 34 and the distributor 20, in the invention, is minimal because it is easy to maintain a tight clearance here (at low manufacturing cost) and because the leakage area is small since the diameter of the terminal end 28 is small relative to the piston diameter. Relative to typical, valved-cycle devices, device 10 incorporating the present invention has the benefit that valve element head losses are eliminated as are those associated with the high loss flow path between a valve and the return chamber of 44 of the hammer 34. In addition, as will be explained in the ensuing text, the present invention permits application where length and weight constrains usually dictate the use of a valved cycle. These constraints are always important for hand held tools and most mounted paving breaker and pile driver applications.

In FIGS. 4 through 11, same or similar index numbers thereon signify same or similar parts or components as such like-indexed parts and components in FIG. 1.

FIG. 4 is a scaled up version of FIG. 1 without the chuck 16 or backhead shown. It is presented here to emphasize the fact that the hardware is easily manufactured and assembled regardless of the size of the hammer. Thus, if FIG. 4 is considered to be half scale, it has a bore of six inches and nominal stroke of four inches. This translates into a blow energy of about fifteen hundred foot pounds when three hundred psi air is used to power the hammer 34*a*. On the other hand, FIG. 1 considered at full scale will produce ten foot pounds when operated on one hundred psi air and it is clear that there are no manufacturing problems associated with the small scale application.

Figure 5:
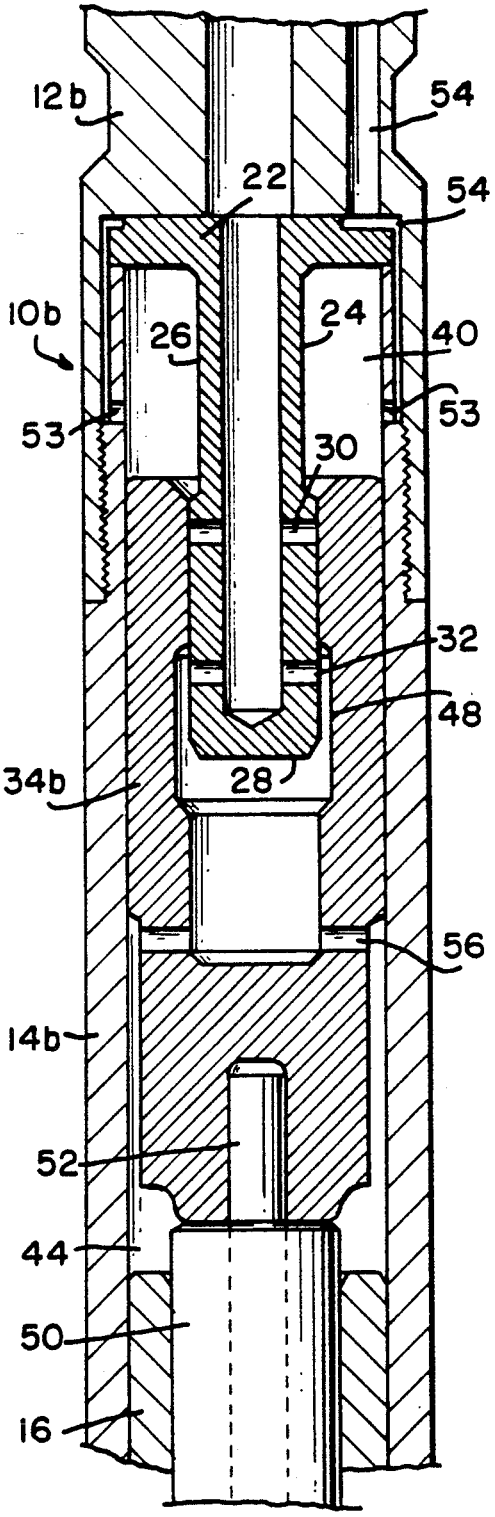
FIG. 5 is a cross-sectional view, similar to those of FIGS. 1 and 4, in which the invention is used in a down hole rock drill.

FIG. 5 shows a modified embodiment 10B of the invention for a down hole rock drill (DHD) application 10*b*. Here it is necessary to have air flow through the center of the drill bit 50 for the purpose of flushing rock cuttings from the region of rock chip formation at the bit - rock interface. This is accomplished in the conventional manner of DHD technology with the use of an exhaust tube 52 as shown to define the exhaust porting for the return chamber 44. As shown in FIG. 5, the exhaust of the drive chamber is achieved via cross holes 53 in the housing 14*b* of the DHD (as usual for the invention) and thence through exhaust duct galleries 54 in the backhead 12 for rear axial discharge.

In the DHD application of FIG. 5 the functioning of the distributor 20 remains as described and only the mechanical details of the exhaust porting have been modified. Again, it is clear that manufacture of the disclosed DHD is a simple task even on the small scale represented in FIG. 5. No new tight tolerancing is needed (including the cross holes 56 in the piston 34*b* for the supply of the return chamber 44), and the distributor 20 remains a very simple component.

The DHD version of the invention presents two important side benefits associated with the rear exhaust of the drive chamber. First, it reduces the back pressure on the hammer cycle because only the air in the return chamber 44 must flow through the limited flow areas at the front of the drill bit 50. Thus, the invention leads to a higher than normal mean effective pressure than conventional DHD designs. The second added benefit of dumping only the return chamber air through the bit 50 is that it produces lower than normal flushing velocities and dynamic pressures around the front face of the bit 50. This reduces the wear rate of the bit body which is often the pacing item on bit life. Thus, the basic inventive concept as modified for the DHD application is considered a most important innovation of this disclosure. Other methods in the art which use central supply of air with conventional exhaust porting lose the two important added advantages cited in this paragraph. In addition, they do not preserve the previously cited simplicity and low cost of the presently disclosed air distributor 20, and they require a complicated multiplicity of holes in the piston to produce the flow paths required for operation of the cycle.

FIG. 6 presents a half scale assembly of a fifteen to twenty pound class demolition tool 10*c*. The front end of the demolition tool shown consists of a front end housing 16*a* and a standard tool shank bearing or "nozzle" 16*b* which accepts standard hex, round or square tool shanks. Similarly, the retainer 16*c* and the tool buffer assembly 16*d* are standard parts for demolition tools as is the grip type handle 12*a*. The handle is bolted to the tool assembly flanges (not shown in the cross section.)

FIG. 6 represents an alternate embodiment of the invention in that the piston 34 has only two internal diameters, the internal diameter D of FIG. 1 having been removed. This admits the shortest, lightest weight piston for a given stroke clearance with the result that the blow frequency of the percussor is maximized. In addition, the exhaust ports 42 now serve both the drive and return chambers. To facilitate the return chamber exhaust process the outer surface of the piston has a gallery 46*a* and a set of flutes 46*b*; thus, when the gallery 46*a* communicates with ports 42, the return chamber air exhausts through the flutes, gallery and ports to the low pressure ambient air. This arrangement admits a simple exhaust deflector/muffler (not shown) around the ports 42 to serve the purpose of directing and muffling the exhaust flow away from the operator.

Figure 7:
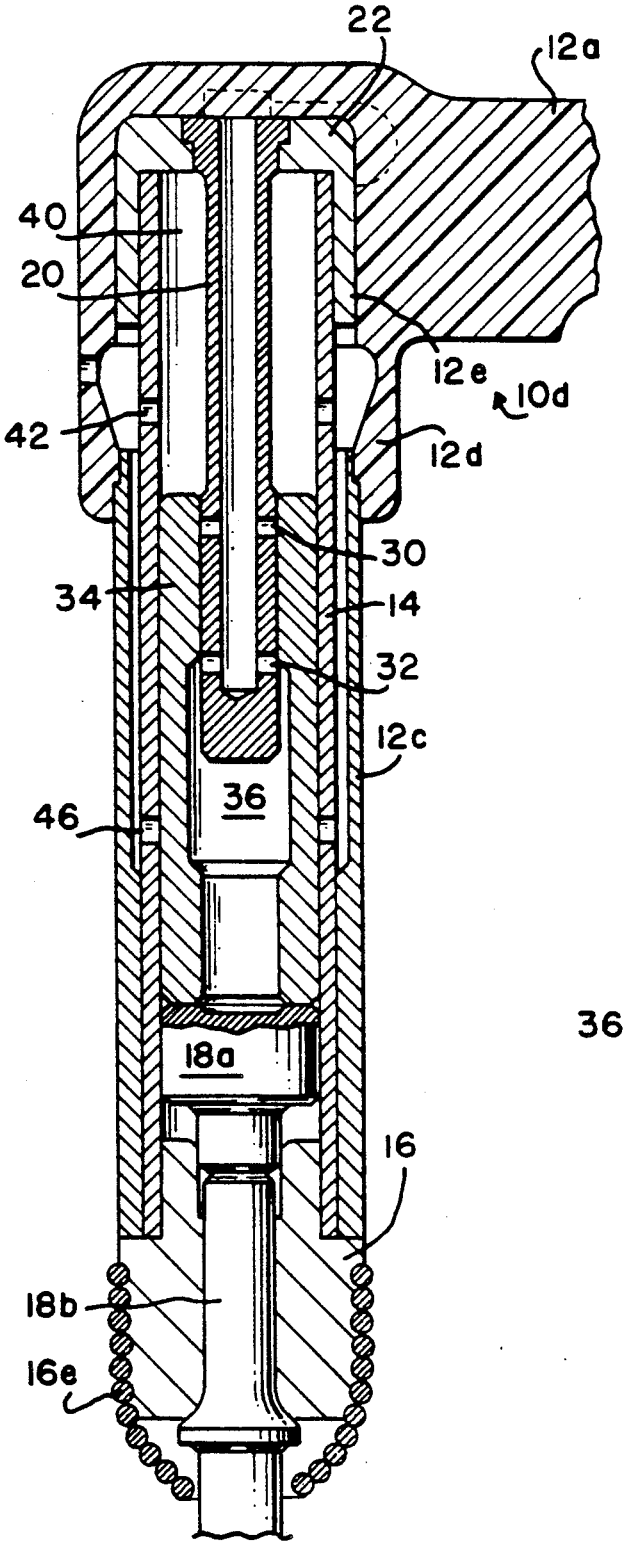

The light weight piston of FIG. 6 is shown with an anvil 18*a* as well as the tool shank 18*b*. This permits high impact surface area, relatively low piston impact stress and high impact energy transfer with the small standard lateral dimensions of the tool shank. FIG. 7 represents still another embodiment 10*d* of the invention in a full scale, light weight riveter. The (molded plastic) pistol grip handle shown is standard for riveters, and it has an extension 12*d* which forms the exhaust deflector. The latter mates to a muffler sleeve 12*c* which has an internal annulus to direct the return chamber exhaust air to the interior of the exhaust deflector 12*d*. The chuck 16 shown here accepts a standard spring tool riveter jackset shank 18*b* as well as a standard spring tool retainer 16*e*. The assembly cap 12*e* is shown here in combination with the seat 22 of the air distributor 20. In all other respects the construction and cycle operation are as described with reference to FIGS. 1 and 2.

Figure 8:
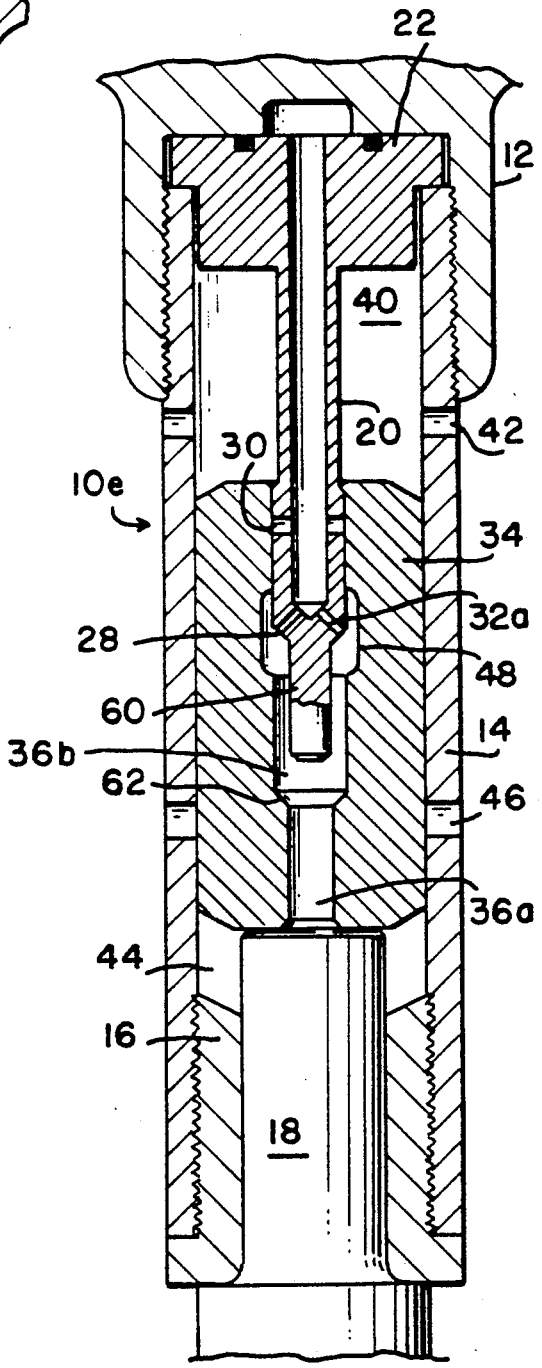
FIG. 8 is an illustration, corresponding, generally, to that of FIG. 1, albeit of an alternative embodiment of the invention.

FIG. 8 presents a variation 10*e* of the preferred embodiment of FIG. 1. Here a plug 60 has been added to the distributor terminal end 28 so that the return chamber supply air is cut off by this plug instead of the porting gallery 48. In addition the supply ports 32*a* are positioned so that the internal supply chamber 36*b* is in constant communication with the high pressure air supply.

Now the piston internal face area 62 provides a driving force (equal to the supply pressure times the area 62) throughout the cycle. This feature may be useful in low frequency, high blow energy applications.

Figure 9:
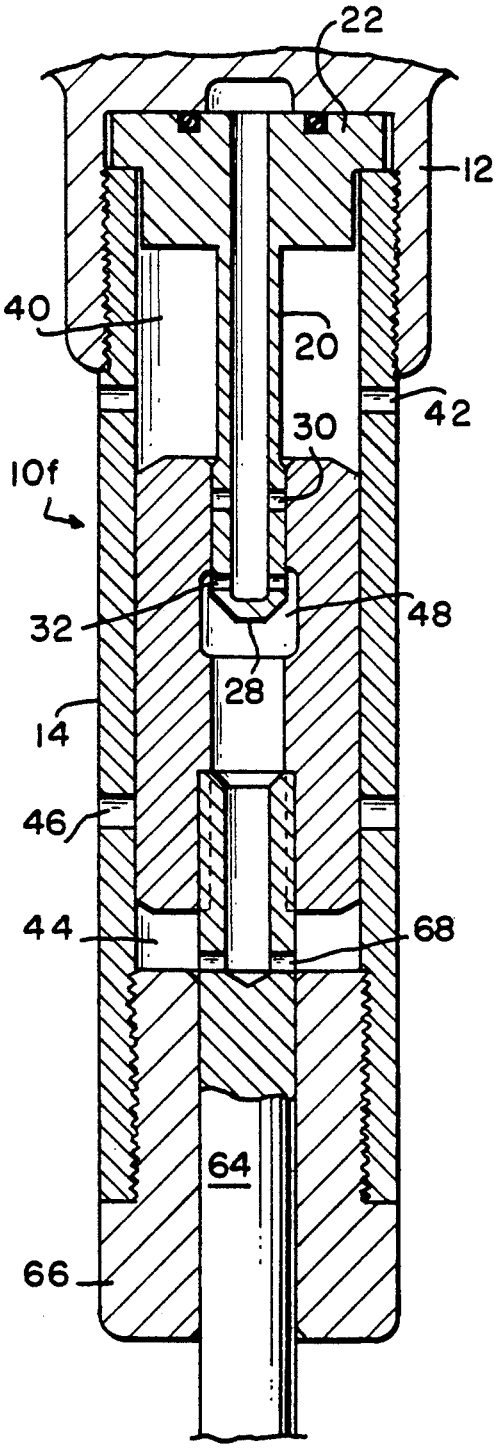
FIG. 9 is an illustration, also in cross-section, of a device which hurls the tool at the work, the same incorporating the invention.

Another variation 10*f* of the basic invention is shown in FIG. 9; it represents applications where it is desired to hurl the tool at the work. Tampers and rammers are examples of hurled tool hammers. As shown in FIG. 9, a tool rod 64 extends from the hammer piston through the rod bearing 66. The cycle works exactly as described in connection with FIGS. 2A through 2D, but now the return chamber 44 is supplied through auxiliary supply ports 68. The front cushion feature is preserved in this embodiment because, as is clear from FIG. 9, the auxiliary ports 68 close off from the return chamber 44 when the piston-rod assembly moves below the design point of tool-load impact. As usual, start-up is achieved by applying a normal feed force to move the piston up toward its design impact position.

Figure 10:
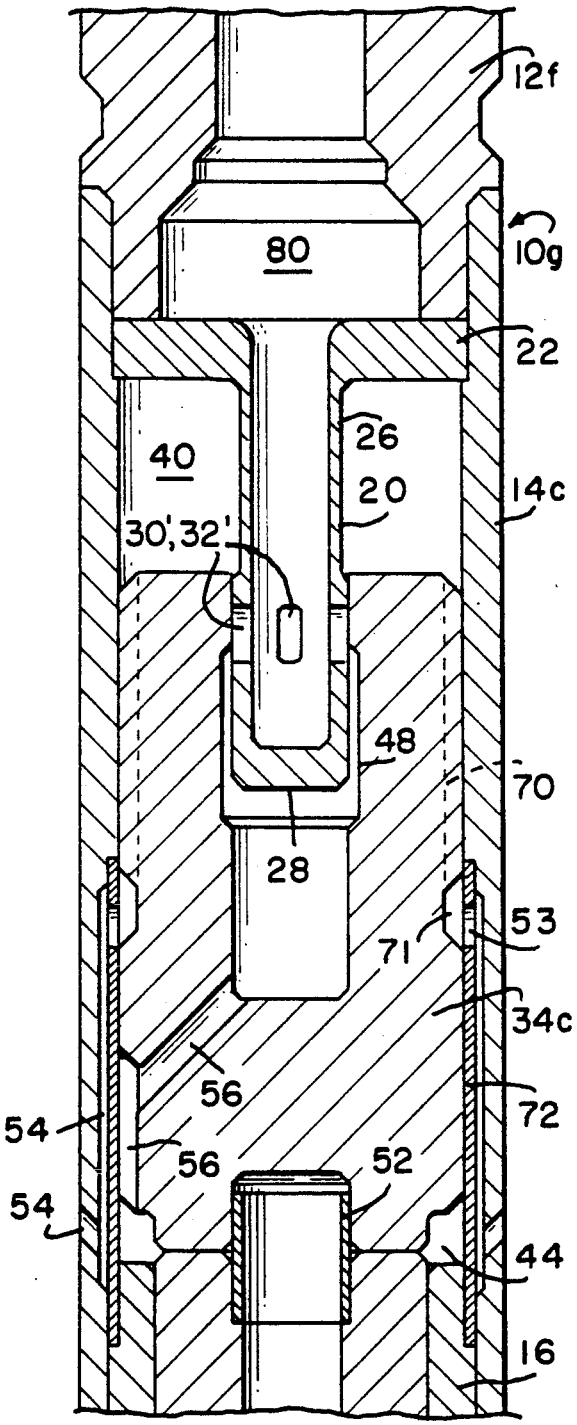
FIG. 10 illustrates an alternative embodiment of a down hole rock drill having the invention therein.

FIG. 10 depicts another embodiment 10*g* of the invention in a modified down the hole rock drill. Herein the hammer piston 34*c* has longitudinal grooves 70 in the upper portion thereof, the same terminating in the gallery 71. When the piston is in the low positions of its stroking motion the gallery 71 is in communication with cross ports 53 in the internal exhaust cylinder 72. These in turn communicate with the outer exhaust passages 54 in the housing 14*c* to permit the exhaust of compressed air from the drive chamber 40. Another feature of the embodiment 10*g* is the header 80 in the backhead 12*f*. This header permits the installation of a check valve in the backhead (not shown), as is common in deep hole drills. In combination with the low position of the cross ports 53 the check valve prevents crucial internal parts of the drill from being contaminated with dirt-laden water when the drill is in the hole, but not operating. The cross ports 56 conduct the motive compressed air to the return chamber 44, the slots 30', 32' are an alternate embodiment and provide the identical function of the cross holes 30 and 32 and, in all other significant respects the embodiment 10*g* corresponds, generally, with embodiment 10*b* of FIG. 5.

Figure 11:
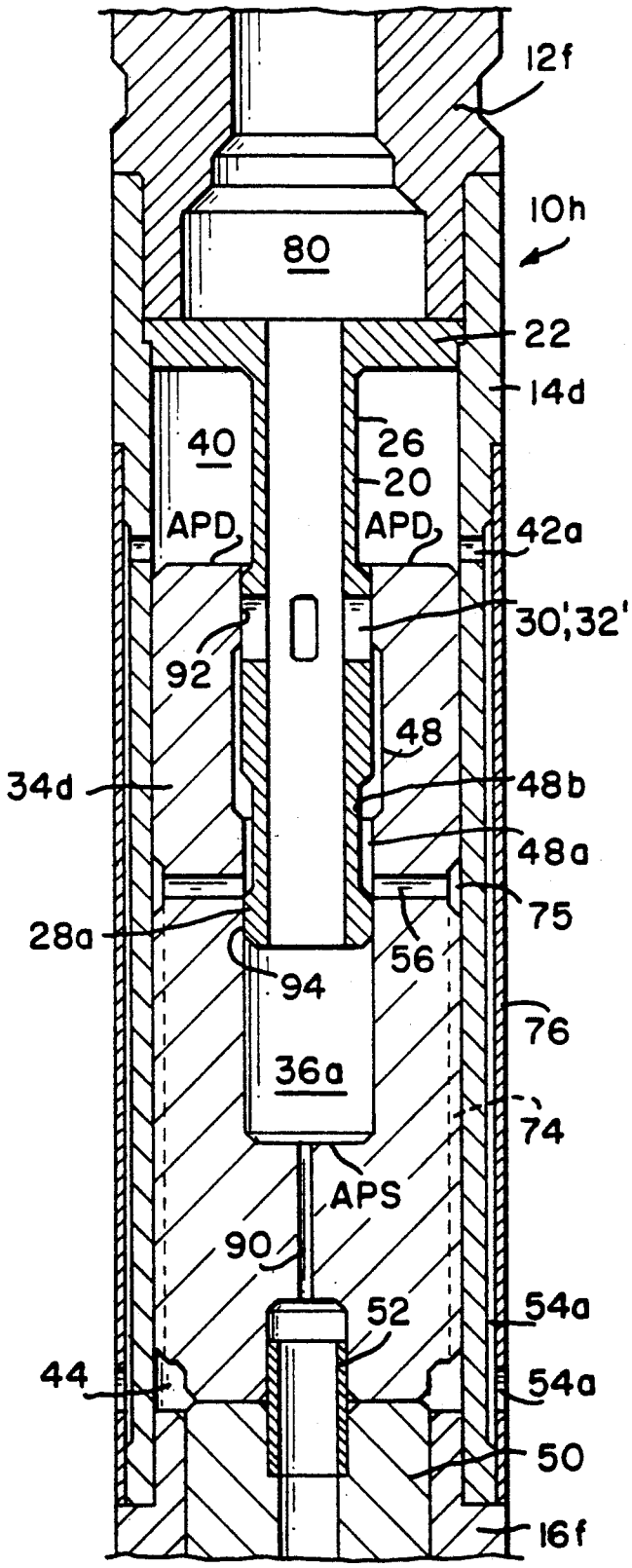
FIG. 11 illustrates another embodiment of the invention in a rock drill application.

FIG. 11 depicts yet another embodiment 10*h* of the invention in a modified down the hole rock drill. Herein, the air distributor 20 has an open termination 28*a* so that the internal bore 36*a* is in constant communication with the motive air supply. (Thus, during the drive stroke the high pressure motive air acts on the full bore area ["APD" plus "APS"], and produces a higher energy blow than other embodiments having the same bore.) The exhaust ports 42*a* in housing 14*d* communicate with the outer ducts 54*a* formed via the external sleeve 76 to permit the drive chamber 40 to exhaust near the bottom of the drill as in the embodiment 10*g* of FIG. 11. (Clearly, the sleeve 76 could be installed internally to the housing 14*d* as an alternative which is similar to that of FIG. 10.) The additional unique feature of embodiment 10*h* is in the manner of directing motive compressed air to the return chamber 44. This is accomplished by an annular recess 48*b* in the distributor 20 which forms gallery 48*a* and which communicates with the piston gallery 48 and the cross ports 56 in the piston 34*d* when the piston is in the lower positions of its stroking cycle. The cross ports 56 terminate in an annular recess 75 which, in turn, communicates with the return chamber 44 via grooves 74 in the piston. When the drill bit 50 is in a lower than normal position the piston must be cushioned as usual. In the embodiment 10*h* this is accomplished, as the piston 34*d* moves below the position shown in FIG. 11, via the supply slots 30', 32' being cut off from communication with the gallery 48, by piston land 92, while the cross ports 56 are blocked by land 94 of the extension 28*a* of the motive air distributor. In all other significant respects the percussive cycle of embodiment 10*h* operates as does that of embodiment 10*g* and the basic invention of embodiment 10. However, the hole 90 through the piston admits constant communication of compressed air with the exhaust bore in the drill bit. This is common in deep hole drills where excess drill hole cleaning air is desirable.

CLOSURE

Various embodiments of the basic invention concept of FIG. 1 have been presented to establish that the concept i) has application to any air powered percussive device;

ii) maintains its great advantage of simplicity and low cost regardless of the scale of the application; and iii) offers the additional benefits of light weight and short length relative to state of the art hammers.

Furthermore, these benefits are realized without sacrificing energy conversion efficiency and, in fact, with somewhat increased efficiency relative to the most efficient state of the art cycles.

The invention, in its several embodiments and applications, offers significant cost savings as compared to the known, conventional valved or valveless devices, particularly in that, as noted earlier, it is only the ported, terminal end 28 of the novel pneumatic distributor 20 (and 20*a*) which has to be toleranced with respect to the diameters "A" and "C" of the hammer piston 34 (and 34*a*, 34*b*, 34*c*). It will be appreciated that the pneu 20 (and 20*a*) replaces the valves of prior devices, as well as numerous tight tolerance parts and machining operations such as are required in the manufacture and maintenance of present valveless devices. Its use admits of the coincident use of a simple, cylindrical housing 14 (and 14*a*, 14*b*, 14*c*), in place of the heavy and costly barrel of valved chippers and breakers, and the like. Similarly, the simple housing(s) replace the complex wear sleeves of prior art valveless hammer devices, while obviating any need for costly concentricity requirements and precision machining operations on the outer diameter of the piston. The pneumatic distributor (20 and 20*a*) has no moving parts. It is loaded only with internal air pressure, and can be a molded plastic article of manufacture. While I have described my invention in connection with specific embodiments thereof, it is to be clearly understood that this is done only by way of example, and not as a limitation to the scope of my invention, as set forth in the objects thereof, and in the appended claims.

I claim:

1. For a percussive tool, a housing, a hammer piston, and a pneumatic distributor, comprising:

a straight, cylindrical housing having a longitudinal axis and an inner, cylindrical surface; and a hammer piston, reciprocable within said housing;

said hammer piston having but a single straight, longitudinal bore formed axially therewith and centrally thereof; wherein said housing has means opening therethrough for venting fluid therefrom;

said pneumatic distributor comprises a sole means for admitting compressed air into said housing, and has an elongate tube for conducting air therethrough;

said tube has a mounting end attached to an end of said housing, and a projecting portion in penetration of said hammer piston;

said projecting portion comprises (a) a terminal end which has porting formed therein for admitting compressed air directly into said bore, and which defines a fine, substantially sealing, relatively slidable clearance with said bore, and (b) a shank having a constant, uniform, outside diameter fully therealong; wherein (a) said distributor, (b) said housing inner, cylindrical surface, and (c) said hammer piston cooperate to define a drive stroke chamber within one end of said housing, and a return stroke chamber within an opposite end of said housing;

said inner, cylindrical surface of said housing has a constant diameter throughout the length thereof which encompasses said drive and return stroke chambers and said hammer piston;

said fluid venting means opens onto both of said chambers; and said tube and hammer piston comprise means cooperative, with reciprocation of said hammer piston, for sealingly closing off each said stroke chamber from said fluid venting means and said porting and, consequently, for defining a front cushion, for said hammer piston, wholly within said return stroke chamber, and a rear cushion, for said hammer piston, wholly within said drive stroke chamber.

2. The invention, according to claim 1, wherein:

said terminal end has a given outside diameter; and said shank outside diameter is smaller than said given outside diameter of said terminal end.

3. The invention, according to claim 1, wherein:

said hammer piston bore has a first, inside diameter, at one end thereof, a second, inside diameter, intermediate the length of said bore, which is greater than said first, inside diameter, and a third, inside diameter, remote from said first, inside diameter and contiguous with said second, inside diameter, which third, inside diameter is identical to said first, inside diameter.

4. The invention, according to claim 1, wherein:

said hammer piston comprises an elongate annulus which defines said bore therewithin.

5. The invention, according to claim 1, wherein:

said hammer piston has longitudinal flutes formed in, and along a length of, an outer surface thereof.

6. The invention, according to claim 5, wherein:

said hammer piston has an annular recess formed in said outer surface thereof which recess defines a gallery; and said flutes are in fluid-flow communication with said gallery.

7. The invention, according to claim 6, wherein:

said gallery and said flutes comprise means cooperative, pursuant to reciprocation of said hammer piston within said housing, for communicating an end of said hammer piston, which is remote from said fluid venting means, with said fluid venting means for venting fluid from said housing.

8. The invention, according to claim 1, wherein:

said terminal end of said projecting portion of said tube has a given axial length, said porting in said terminal end extends over a given axial length, and said second, inside diameter of said hammer piston bore has a given axial length, and all said given axial lengths comprise means cooperative, with reciprocation of said hammer piston, for communicating, and for interdicting communication of, compressed air, alternatively, with said drive stroke chamber and said return stroke chamber.

* * * * *